US006227964B1

(12) United States Patent
Dawson et al.

(10) Patent No.: US 6,227,964 B1
(45) Date of Patent: May 8, 2001

(54) METHOD OF PRINTING IMAGES AND CHARTS AND PAPER THEREFOR

(75) Inventors: William F. Dawson; Gary R. Hollingsworth, both of Ottawa (CA)

(73) Assignee: VisualProject Inc., Hull (CA)

( * ) Notice: Subject to any disclaimer, the term of this patent is extended or adjusted under 35 U.S.C. 154(b) by 0 days.

(21) Appl. No.: 09/414,893

(22) Filed: Oct. 8, 1999

(30) Foreign Application Priority Data

Oct. 8, 1998 (CA) ..... 2249919

(51) Int. Cl.[7] ..... B41L 1/20

(52) U.S. Cl. ..... 462/8; 462/9; 462/25; 462/27; 281/101

(58) Field of Search ..... 462/8, 9, 25, 26, 462/27, 36; 283/105, 101, 116, 81

(56) References Cited

U.S. PATENT DOCUMENTS 3,565,462 * 2/1971 Gottlieb ..... 281/3
5,364,200 * 11/1994 Russo et al. ..... 402/79
5,509,694 * 4/1996 Laurash et al. ..... 283/81
5,571,587 * 11/1996 Bishop et al. ..... 428/43

* cited by examiner

*Primary Examiner*—Willmon Fridie, Jr.
(74) *Attorney, Agent, or Firm*—Blake, Cassels & Graydon LLP; George E. Fisk

(57) ABSTRACT

Discloses sheet of printable media, such as paper, of a special format for printing, preferably by computer, images (such as charts) which are too large to fit on conventional sized sheets of printed paper, and a method for printing such images. The images are printed in sections onto standard sized paper sheets segmented into a retained portion and a removable portion with a glue strip along one side of the retained portion. The sections of the image are printed on the sheet to predetermined margins extending parallel to the sheet edges. The printing may include inconspicuous marks along a registration boundary to facilitate registration of a pair of sheets. The removable portion is separated from the sheet along a segmentation line that coextends with a registration boundary and two sheets with adjacent portions of an image are overlapped until their portions of the image are in register to present a continuous image without gap or overlap. The glue strip on one is sheet activated to glue the sheets together in register. Optionally the sheets include pre-scored fold lines to facilitate folding joined sheets along predetermined fold lines so that the strip formed from the sheets can fan-folded for storage in a binder.

21 Claims, 5 Drawing Sheets

METHOD OF PRINTING IMAGES AND CHARTS AND PAPER THEREFOR

FIELD OF THE INVENTION

This invention relates to sheets of printable media, such as paper, of special format including segmentable portions which may be separated after printing and activatable glue strips to produce an elongate sheet comprised of discrete sheets.

BACKGROUND OF THE INVENTION

Certain presentations and graphs require printing on a printable media, such as a paper sheet, of a dimension that is most beneficially presented in the form of a strip, for example, presentation charts used in project management. Project management is the planning and control of many activities that must be coordinated to achieve specific goals leading to the completion of an overall given objective. The project management process frequently uses a set of tools which incorporate charts and reports to detail the project for communication within the project team and with others.

One form of project management chart is referred to as a work breakdown structure (WBS) chart. A WBS chart is an organizational diagram type of chart depicting work packages comprising all of the principal elements of a project. Another form of project management chart, used for communication with the project team and with others, is a precedent network (Network) chart, sometimes erroneously referred to as a PERT chart. The Network chart displays activities required to produce the work packages depicted in the WBS chart and shows the relationships between the activities, i.e. the precedents and dependencies between the activities as they flow towards completion of a project.

For practical project management purposes, the WBS and Network charts are usually more than one standard sized page in width. To present either chart may require many standard sized pages to be joined one to the other. As the project evolves, the project management process results in the updating, modifying, and reproducing the project charts as a consequence of project progress. Thus, the WBS and network charts will change during the course of the project, consequently requiring the WBS and network charts to be produced frequently during the course of the project. To allow the charts to be printed on standard sized paper using conventional computer printers or photocopied onto standard sized paper, requires the joining of standard sized pages together to form a completed WBS or Network chart. Joining these pages is a time consuming process and usually requires input from the project manager to lay out the pages in a proper sequence prior to cutting and pasting them together to form the chart. Each time revised charts are produced during the life of a project, several copies are required each for key team members. The page assembly process to produce the charts is a frustrating task and often results in sloppy presentations even though the computer-generated data or the images printed or photocopied on each of the individual pages may be perfect.

SUMMARY OF THE INVENTION

To address these problems of assembly and presentation of standard sized pages to form a chart which extends over several pages, the present invention provides a solution that uses standard sized paper retained by conventional computer driven printers such as laser printer, ink jet printers and the like or by photocopying using conventional photocopiers.

Frequently, the project charts are stored together in a suitable binder, such as a three-ring binder or other standard sized binder into which charts can conveniently be kept. The invention includes forming the pages to include a pre-scored fold-line to facilitate fan-folding a chart for storage in a binder.

The invention comprises standard-sized paper segmented into a removable portion and a retained portion and an activatable glue strip on the back side of the page proximal to the removable portion. The dimension of the retained portion and the width of the glue strip define an image area for the diagrams generated and printed on the page by photocopying or generated from a computer program. Typically the computer generated diagrams include vector lines and text that form images on a standard-sized page. The images or diagrams may be printed to the margin of the retained portion on one side of the retained portion of the page opposite the glue strip. Images or diagrams extending over multiple pages form overlapping portions on adjoining sheets. The overlap of images or the lines, boxes, and text of diagrams permits accurate registration of the images from one sheet to another.

The registration boundary demarking the overlap of one sheet with another may be further indicated by providing at least two registration marks on the right-hand side of each sheet, one at the top and the other on the bottom, to ensure the precise alignment of the overlapping pages along an alignment boundary.

The fan folding process is facilitated by the stiff edges on either side of the glue strip, which occur with the overlap area of one sheet to the other. The stiff edges of overlapping portions of the sheets on the glue strip automatically positions a fold between adjacent sheets so that all pages can be folded into a chart that fits into a standard binder. The computer program preferably always produces an odd number of pages so that the computer generated title page is always folded in as the top page in the binder.

In one of its aspects the invention provides a sheet of paper comprising: a pair of parallel side edges, and top and bottom edges, a segmentation boundary parallel to said side edges forming a removable portion, and a glue strip proximal to said segmentation boundary and parallel to the side edges, said glue being inactive to adhere sheets of paper together until activated.

In another of its aspects the invention provides a method of printing an image on multiple sheets of a printable media comprising the steps of providing at least two of sheets of printable media of predetermined size defining the dimensions of an image area, said sheets each having a removable portion and a retained portion. Each of the sheets having a glue strip on one face of the retained portion parallel to an edge thereof. The glue strip has means to prevent it adhering to another sheet until it is activated. Subdividing the image which it is desired to print into sub-images such that each successive sub-image has a common registration boundary, and such that each successive registration boundary is separated from the previous by a distance equal to a dimension of said image area. Printing a first sub-image on said first one of said sheets and printing a second sub-image, which second sub-image has an image boundary registerable with an image boundary of said first sub-image, on said retained portion of a second one of said sheets.

The preferred embodiments of the invention will be described with reference to the attached drawings in which, throughout the various figures of the drawings, the same reference numerals are generally used to denote the same or analogous features of the invention.

Figure 2:
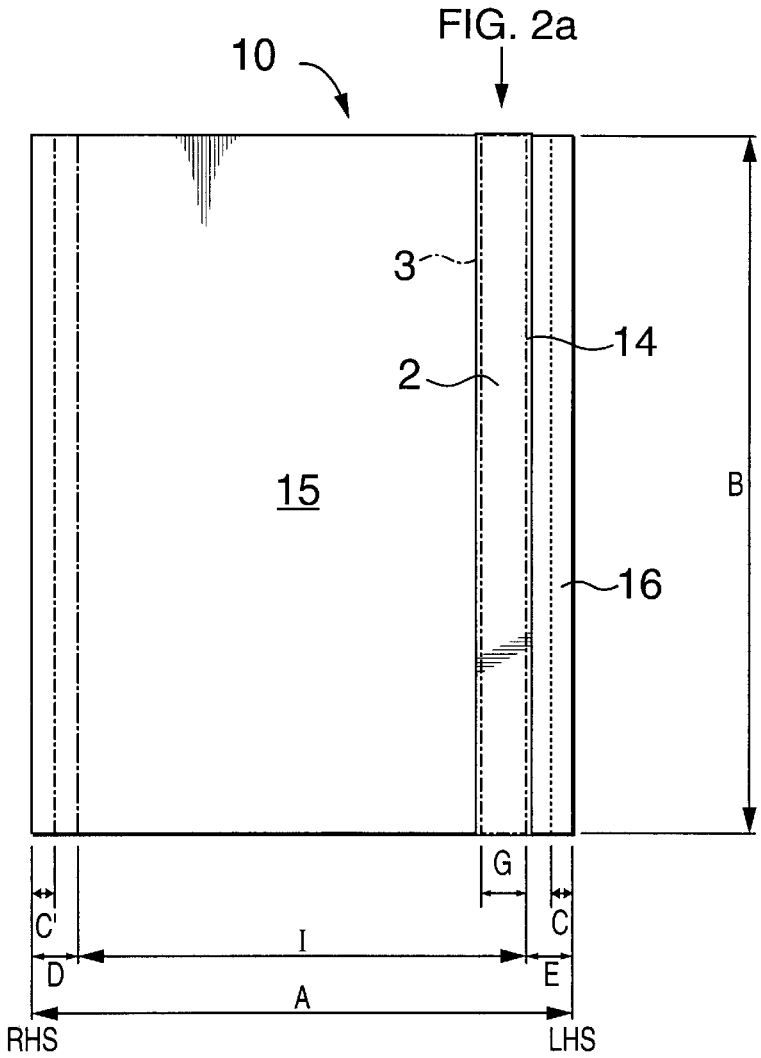
FIG. 2 is the back face view of the page of FIG. 1.
Figure 2A:
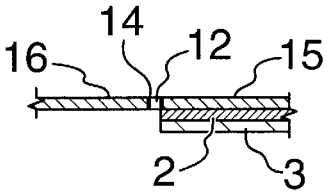

FIG. 2*a* is an end view of a portion of the page of FIG. 2 as viewed in the direction 2*a* on FIG. 2.

Figure 2B:
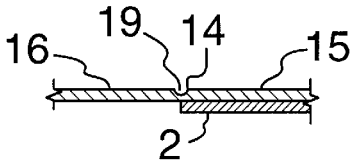

FIG. 2*b* is an end view of an alternate embodiment of FIG. 2*a*

Figure 2C:
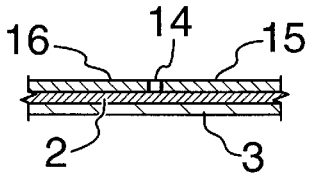

FIG. 2*c* is an end view of another embodiment of FIG. 2*a*.

Figure 3:
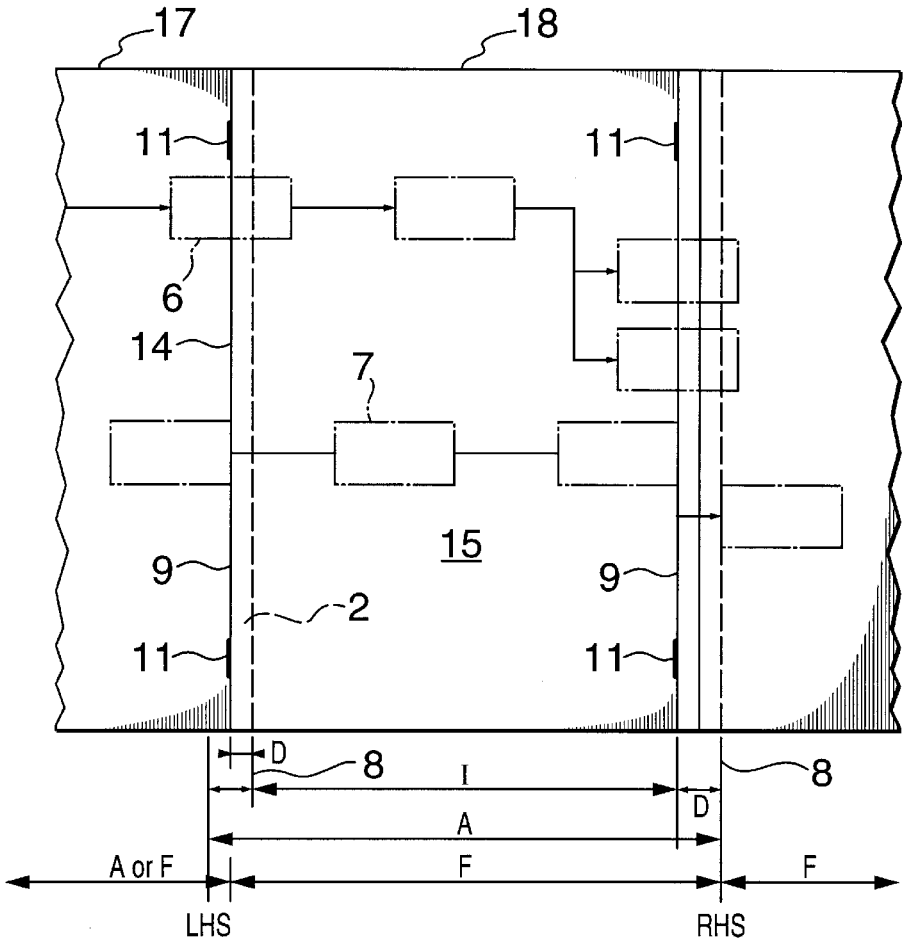

FIG. 3 is a plan view of several assembled pages forming a chart.

Figure 3A:
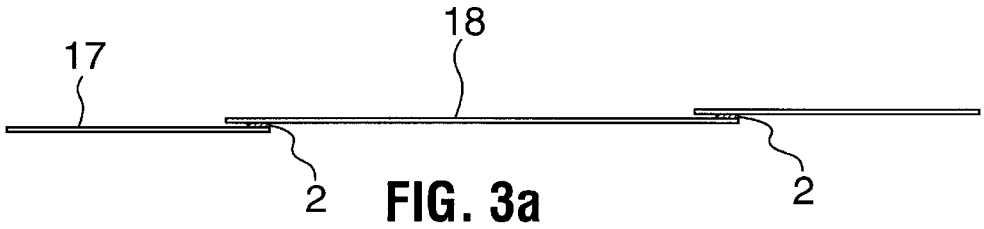

FIG. 3*a* is a end view of the pages of FIG. 3.

Figure 4:
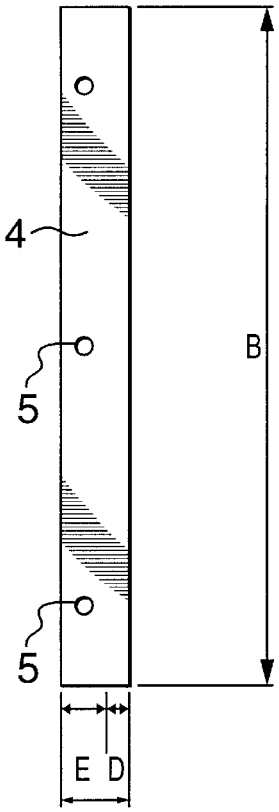

FIG. 4 is a plan view of a binder strip for attachment to a first page of a chart.

Figure 5:
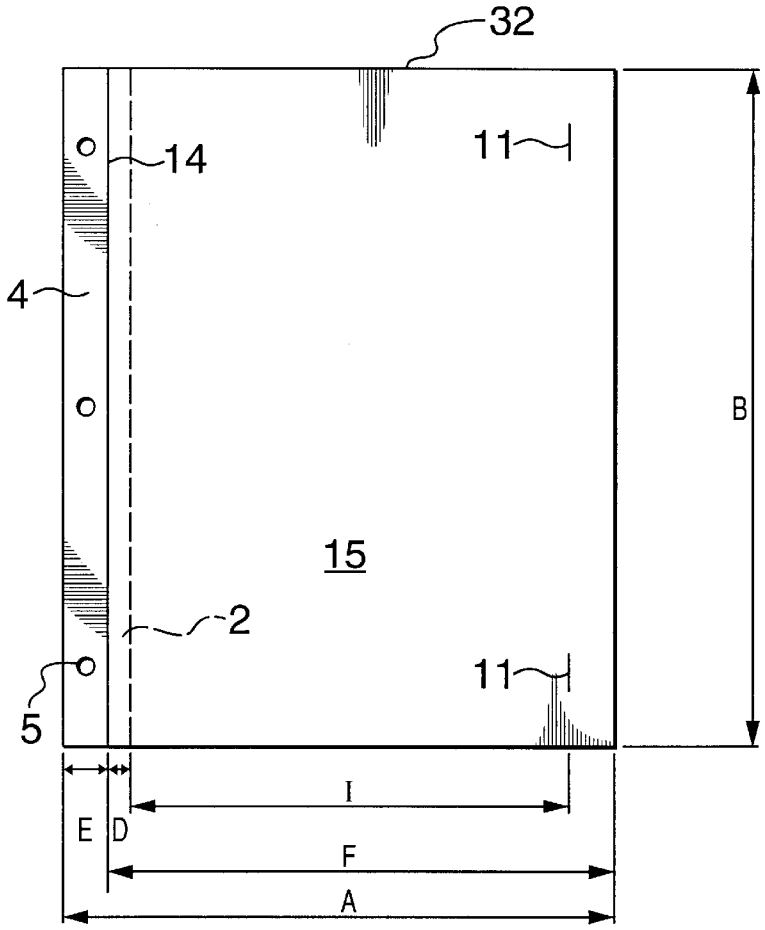

FIG. 5 is a plan view an assembly of the binder strip of FIG. 4 and a first page of a chart.

Figure 5A:
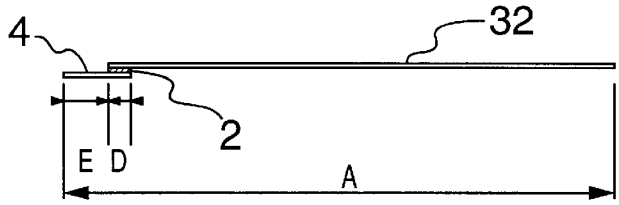

FIG. 5*a* is an end view of the assembly of FIG. 5.

Figure 6:
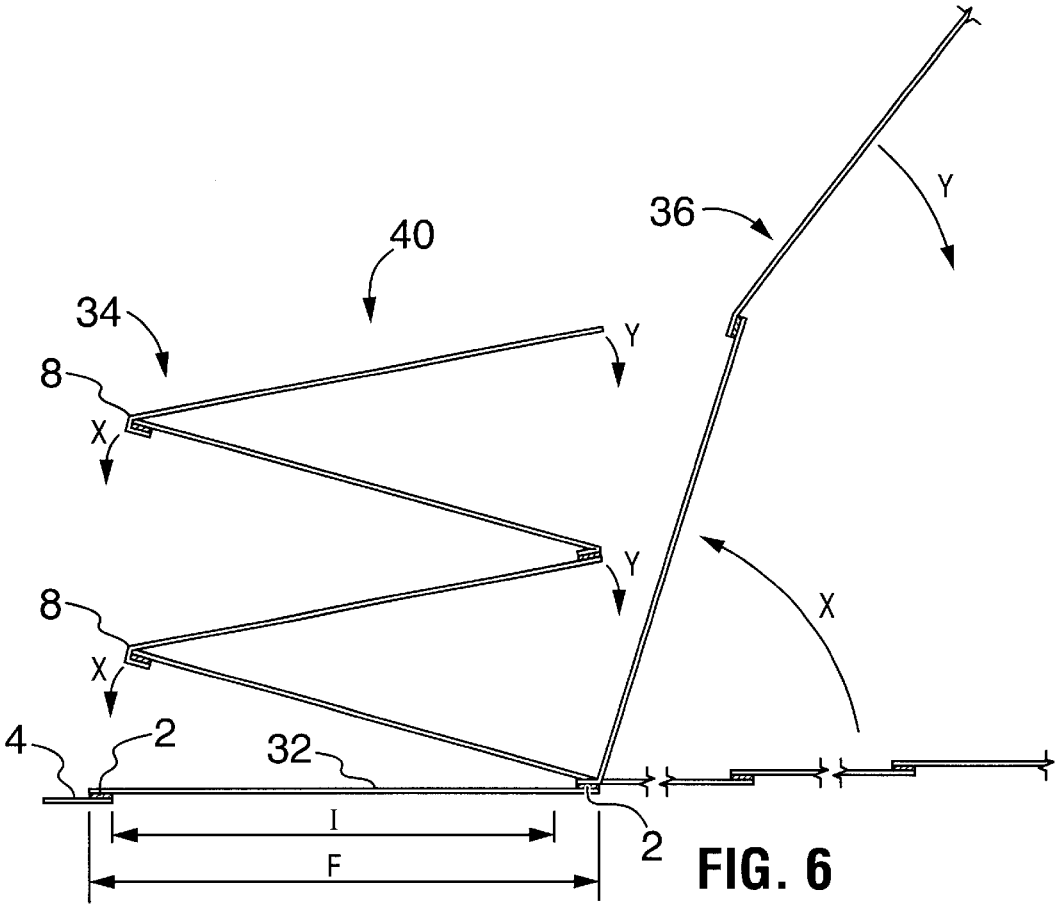

FIG. 6 is an end view of a plurality of pages assembled into a fan-folded sheet or strip.

Figure 7:
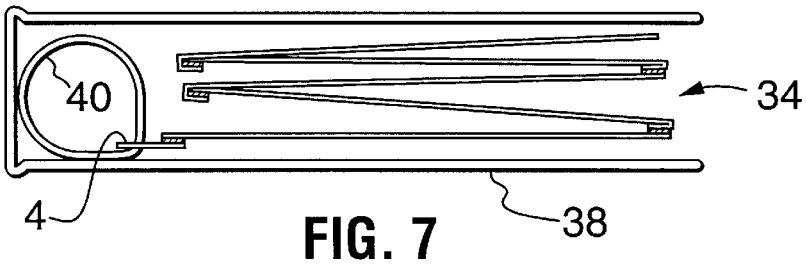

FIG. 7 is an end view of a chart mounted in a 3-ring binder.

DETAILED DESCRIPTION OF THE INVENTION

The invention comprises the physical production of pre-formatted pages which are useful for producing multi-page images and diagrams such as project management charts or other images or diagrams requiring the use of an extended page to produce charts such as organizational type charts or process flow charts and the like.

Figure 1:
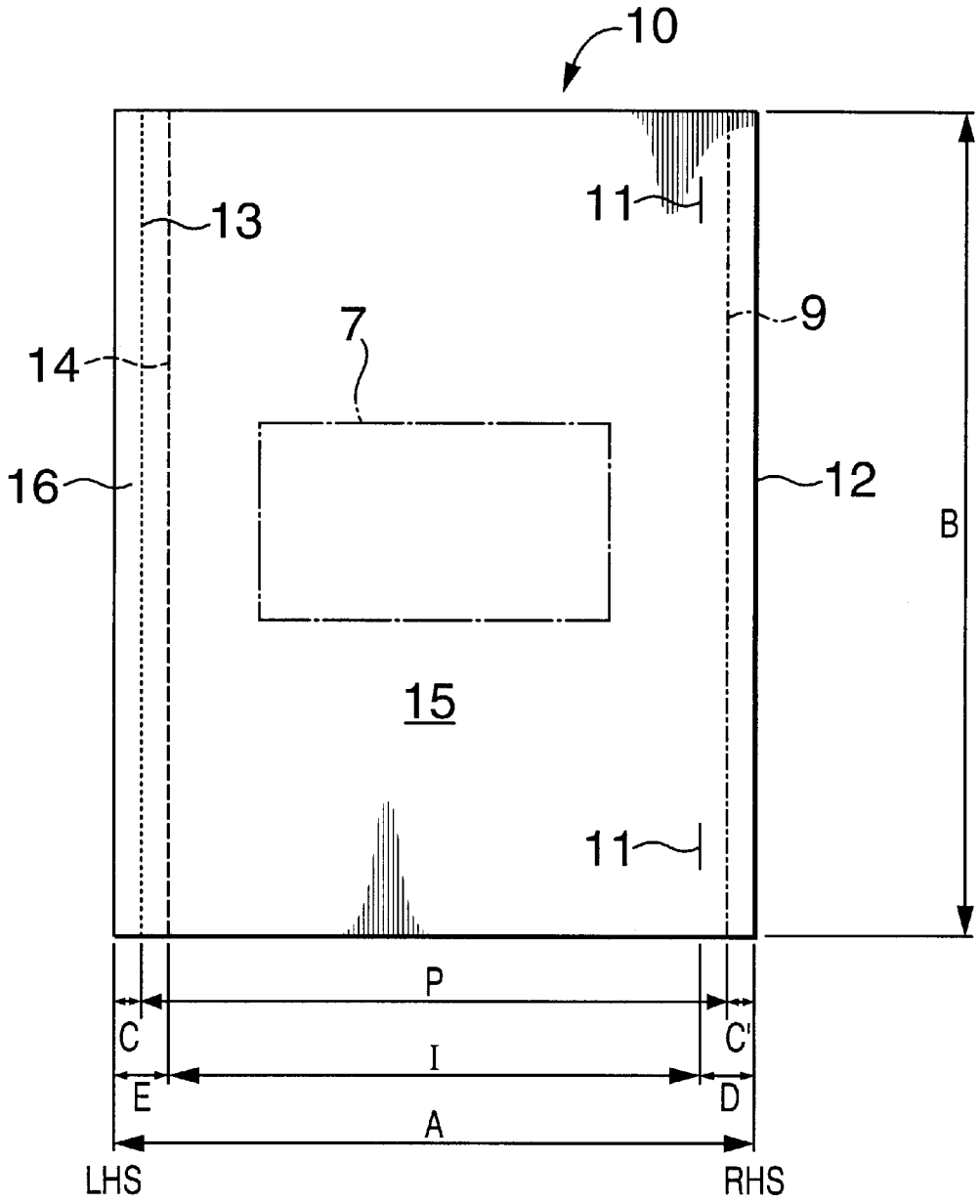
FIG. 1 is a front face view of the preferred embodiment of a page constructed in accordance with the principles of the invention.

FIGS. 1 and 2 show the front and back view respectively of a preferred embodiment of sheet of paper incorporating features of the invention. FIG. 1 shows a page 10 of standard dimensions A×B. For example, the page 10 may be a letter sized paper which is 8½×11 inches or legal sized paper which is 8½×14 inches or A4 paper which is 21 cm×29.7 cm. Each page 10 is suitable for being printed on by a conventional photocopier printer or sheet-fed computer printer, such as a laser printer or ink jet printer. When a sheet of paper 10 is passed through a conventional printer for printing, it is not practicable to print to the physical edges of the page 10. Printing at or near the physical edges of the sheet 10 causes the image forming media, such as the toner or ink applied to the page by the printer, to overflow the page edges and foul the printer by becoming applied to the printer itself. Therefore, the printable area of the page is bounded by margins 13 and 9 which define the limits of the printable area in which the image to be printed on the page is to extend. Dimensions C and C' indicate the margins defining a printable area of the page. Thus, the specific standard letter sized page A×B in common use within a particular territory provides a printable area of width P=A-C-C' on the page.

FIG. 2 shows the reverse side of the page shown in FIG. 1. For clarity, the corresponding sides of the page of FIGS. 1 and 2 have been labelled LHS and RHS for left-hand side and right-hand side. A glue strip 2 of width G is provided on the page. Glue strip 2 is preferably provided on the reverse or rear side of the page as is shown in FIG. 2. Segmentation line 14 defines the boundary of a separable coupling which couples the removable portion 16 to the retained portion 15 of page 10. Segmentation line 14 becomes an edge of retained portion 15 when removable strip 16 is separated from the remainder of sheet 10 after an image on the page 10 has been printed by the printer. Segmentation line 14 forms the registration boundary of the sub-image appearing on the page and the sub-image printed on the next successive page will have an image portion including the registration boundary. Prior to separation of removable portion 16, the left image boundary and separation line 14 are exactly co-extensive along sheet 10. Thus, the image printed on retained portion 15 of page 10 extends across printable area P up to segmentation line 14 and may, on subsequent sheets extend to the left margin 13 which extends beyond the left image boundary and segmentation line 14. Following printing, separation of removable portion 16 results in the remaining left hand edge of page 10 now exactly coextending with the image registration boundary and the left hand edge of retained portion 15. Thus, after separation of the removable portion 16, image 7 (which may include computer generated graphics) can extend to the physical edge of the retained portion 15 of the page.

Dimension D defines the width of the overlap area of the page. Dimension D is the width or distance to the right registration boundary of the retained portion 15 (also as shown in FIG. 1) and is preferably substantially the same dimension as G the width of the glue strip 2 proximal to the opposite parallel edge of retained portion 15 of the page as depicted in FIG. 2. The front face of the page shown in FIG. 1 obscures the glue strip which appears on the reverse side of the page. In the preferred embodiment, glue strip 2 is covered with a protective tape 3 and glue strip 2 is activated by removing protective tape 3 therefrom to allow the pages to be glued to each other during the process of attaching the pages to assemble the chart. In the preferred embodiment, glue strip 2 is placed on the rear of the page to avoid obstructing or intruding on the retained front side of the page. It will, however, be realised that the glue strip 2 may be provided in the overlap area, of width D, on the front portion of the page without departing from the spirit of the invention. In this manner, an image area of width I is provided on the retained portion 15 of the page. The image area width I is the paper width A less the width E of the removable portion 16 and the width D of the overlap area.

Other forms of glue activation can be used, for example, water activated glues can be used.

FIG. 2*a* shows an end view of that portion of the page of FIG. 2 encircled by 2*abc*. In the preferred embodiment, segmentation line 14 is formed by providing a plurality of perforations 12 to produce a sheet 10 from which removable strip 16 can be segmented or removed by pulling or tearing removable strip 16 away from the rest of page 10. FIG. 2*a* also shows glue strip 2 covered by a protective strip 3.

As shown in FIG. 2*b*, segmentation line 14 may alternately be formed by scoring the sheet 10 to form a weakened web 19 of paper extending between retained portion 15 and the removable strip or portion 16. In this arrangement, removable strip 16 can be segmented or removed from retained portion by pulling or tearing removable strip 16 away from the rest of page 10. FIG. 2*b* also shows glue strip 2 which is water activated and, therefore, is not covered by a protective strip.

FIG. 2*c* shows another alternate embodiment of segmentation line 14. Segmentation line 14 is formed by cutting through sheet 10 to separate removable portion 16 from retained portion 15. Glue strip 2 is formed on both retained portion 15 and removable portion 16 and protective tape 3 is wide enough to extend across segmentation line 14 to extend to both retained portion 15 and removable portion 16. To activate glue strip 2, protective tape 3 is removed from retained portion 15, exposing glue strip 2 making retained portion 15 ready to be adhered to another sheet or a binder strip as needed.

FIG. 3 shows the relationship between the physical paper configured as described with reference to FIG. 1 and 2 and printed images 6 and 7, which may be printed by photocopying or computer printed, which are printed on the pages. The precise registration of the text and graphics of printed graphic 7 is assisted by the projection of printing to the extreme right margin 9 of the retained portion 15. As previously described, the image left registration boundary is printed to co-extend along segmentation line 14. The image right registration boundary becomes the line defined by the width of overlap area D or the right most side of image area I. This registration boundary is preferably indicated by registration marks 11. Segmentation line 14 becomes the left hand edge or segmentation boundary of the retained portion 15 as segmentation line 14 defines the left boundary of the retained portion when removable portion 16 is removed. When removable strip 16 is removed from the sheet 10 following printing, the remaining dimension of the retained portion 15 of the page, which has a width of dimension F, includes the image area which has a width of dimension I. Successive retained portions 15 having successive image areas of a width of dimension I are bonded together by removing protective strip 3 from glue strip 2 and positioning successive page 18 above preceding page 17. The actual image printed may extend to include overlapping strips outside the image area I, but when the overlapping portions of the image are overlapped, the only visible area on each page is the image area of width D. When the pages are adhered together retained portions 15 of the glue strip 2 of page 18 adheres to page 17 over overlap area D of page 17. Preferably, alignment of a successive page 18 with respect to a previous page 17 can be accomplished by positioning the edge formed by segmentation line 14 of page 18 to co-extend or overlap with the overlap portion of the image extending to the right margin 9 of previous page 17. Alignment is visually aided by any graphics or images 16 which span one page to the next. During printing, preferably inconspicuous alignment marks 11 are printed to provide a visual indication of the right alignment boundary which is usually located inward from the right margin 9 of the page so that successive pages may be aligned. Inconspicuous alignment marks 11 are particularly helpful when there is no graphic 6 spanning the two pages to aid in the alignment of one page to the other. Alignment marks 11 preferably are printed in the upper and lower portion of the page and are printed along the alignment boundary of the page in such a location that they become inconspicuous when page 18 is attached to page 17. In this manner, images, diagrams or computer graphics 7 that appear on each page can be visually coupled together.

Diagrams which span two pages, such as image or graphic 6, will be produced with a portion appearing on a page 17 and the remaining portion appearing on a page 18. As will be understood, the graphics can extend across more than one page and graphic 6 is a particular example of a graphic which extends across just two pages. When a graphic or image extends across two pages, it is preferable to print an overlapping portion of the image or graphic 6 beyond the registration boundary on at least one page to aid in registration of one page to the other. The images, graphics and text 7 are randomly located on each page depending on the thing depicted, however, the pages are coupled together in the manner aforesaid to provide a continuous graphic produced over the total width of the image or chart to be produced using any required number of pages as may be needed to obtain the desired length of the image or chart sought to be produced. Overlapping pages 17 and 18 may also form a fold line which may be on either side of glue strip 2, but the fold line is preferably provided along line 8 for ease of production of a fan-fold chart that may be bound as subsequently described.

FIG. 3*a* shows an end view of the joined pages of FIG. 3. Page 18 adheres to page 17 by means of glue 2 in the overlapping portion of the pages.

FIG. 4 shows a pre-cut binder strip 4 that can be applied to the leftmost or first page of a chart. In the figure, binder strip 4 includes holes 5 which are pre-cut at-the correct dimension and spacing for mounting in a three-ring binder. The holes 5 are shown for exemplification of the type of holes which can be pre-cut or user punched into binder strip 4. It will be appreciated that it is not necessary that any holes 5 be pre-punched into binder strip 4 as there are varying types of binders and hole punching alignment requirements will be dictated by the needs of the user. Binder strip 4 preferably has a length B to correspond with the length of the pages to which it will be attached. Binder strip 4 has a width of at least D plus E which is the width E of the removable portion plus at least the width D of the page overlap area. The overlap area of width D is also preferably the width G of the glue strip 2 of the page that will be affixed to binder strip 4. The binder strip 4 may be constructed from any suitable material such as paper, bristol board, cardboard, plastic film, or plastic sheet material that the glue will adhere to.

FIG. 5 shows an assembly of a binder strip 4 and the first or leftmost page 32 of a chart. To assemble the pieces, the binder strip 4 of dimension E plus D by B is positioned below page 32. Removable strip 16 (not shown) has been removed from page 32 by separation of the page along segmentation line 14. The glue strip 2 on the lower portion of page 32 is activated by removing protective strip 3 (not shown) and the page 32 positioned above binder strip 4 and pressed down onto binder strip 4 to adhere page 32 to binder strip 4.

FIG. 5*a* shows the assembly of FIG. 5 in end view.

FIG. 6 shows a fan-folded chart 34 including a binding strip 4 attached to the first page 32 of the chart 34. A user can produce a chart from pages constructed in accordance with the invention which can be kept in a standard sized ring binder. The chart can be folded out for viewing. The drawing shows a first page attached to a binding strip 4 and all subsequent pages of the chart are fan-folded, by rotation along arrows X-and-Y, from a partially open position 36 to an intermediate position 40 as shown in FIG. 6.

FIG. 7 shows a fan-folded chart 34 in a folded position and in place in a 3-ring binder 38. Binding strip 4 is in place at the end of the fan-folded chart positioned on the end of the chart to allow the fan-folded chart to clear the binding rings 4. The fan-folded chart fits into the space between the cover leaves of the binder 38. Each page is folded along a fold line 8 to accurately guides the fold. A person reading a chart contained within the binder can easily fold out long charts for examination and refold the chart back for storage in the binder as depicted in FIG. 7. As may be appreciated, the charts can also be used or displayed on a wall and subsequently neatly folded and placed into the binder 38 for storage.

Now that the invention has been explained with reference to the attached drawings, numerous substitutions, modifications, and equivalents will occur to those skilled in the art which are within the scope of the invention as defined in the claims appended hereto.

The embodiments of the invention in which an exclusive property or privilege is claimed are defined as follows:

1. A sheet of printable media comprising:

a pair of parallel side edges, and top and bottom edges, a segmentation boundary parallel to said side edges, dividing said sheet into a smaller removable portion, and a larger retained portion, and a glue strip adjacent said segmentation boundary on said retained portion and parallel to said side edges, said glue strip comprising glue which is inactive to adhere said sheet to another sheet of printable media until activated.

2. The sheet of claim 1, wherein said segmentation boundary comprises closely spaced perforations.

3. The sheet of claim 1, wherein said segmentation boundary comprises a weakened web.

4. The sheet of claim 1, further including a fold line formed in said sheet to facilitate folding, said fold line being parallel to the side edges.

5. The sheet of claim 4, wherein said glue strip extends between said segmentation line and said fold line.

6. The sheet of claim 5, further including a removable protective strip wherein said glue is activated by removing said removable protective strip.

7. The sheet of claim 6, wherein said glue strip spans said segmentation boundary and said removable protective strip overlies said glue strip whereby removing said removable protective strip releases said removable portion from said retained portion.

8. The sheet of claim 1, wherein said printable media is paper.

9. A sheet of paper comprising:

a pair of parallel side edges, and top and bottom edges, a segmentation boundary parallel to said side edges into side-by-side portions dividing said sheets into a smaller removable portion and a larger retained portion, and a glue strip adjacent to said segmentation boundary and parallel to the side edges, said glue strip comprising glue which is inactive to adhere said sheet to another sheet of paper until activated.

10. The sheet of claim 9, wherein said segmentation boundary comprises closely spaced perforations.

11. The sheet of claim 9, wherein said segmentation boundary comprises a weakened web.

12. The sheet of claim 9, further including a fold line formed in said sheet to facilitate folding, said fold line being parallel to the side edges.

13. The sheet of claim 9, wherein said glue strip extends between said segmentation line and said fold line.

14. The sheet of claim 13, further including a removable protective strip wherein said glue is activated by removing said removable protective strip.

15. The sheet of claim 14, wherein said glue strip spans said segmentation boundary and said removable protective strip overlies said glue strip whereby removing said removable protective strip releases said removable portion from said retained portion.

16. A method of printing an image on multiple sheets of a printable media comprising the steps of:

(i) providing at least a first sheet and a second sheet of printable media of predetermined size and having an image receiving area of predetermined dimensions having a removable portion and a retained portion, and each said sheet having a glue strip on one face of the retained portion parallel to an edge thereof, said glue strip having means to prevent it adhering to another sheet until it is activated, (ii) subdividing an image which it is desired to print into sub-images each successive sub-image having a common registration boundary, and each successive registration boundary being separated from the preceding registration boundary by a distance equal to a dimension of said image area, (iii) printing a first sub-image on said first sheet, and (iv) printing a second sub-image, which second sub-image has an image boundary registerable with an image boundary of said fist sub-image on said retained portion of a second sheet, image boundary which is registerable with an image boundary of the first sub-image being at the boundary between the retained portion and the removable portion of said second sheet.

17. The method of claim 16 further including the steps of:

(i) removing said removable portions of said sheets, and (ii) overlapping the retained portions of said sheets such that the said first and second sub-images together to form a continuous image and activating the glue strip of said second sheet so as to adhere the retained portions in their overlapped position.

18. The method of claim 16, wherein said printable media is paper.

19. The method of claim 16, wherein said subimages are printed on the sheets on the face opposed from the glue strip.

20. The method of claim 16, where at least one of such first and second sub-image has an image portion beyond its image boundary which includes the continuation of its sub-image at the registerable boundary into the other of said first and second sub-image at the registerable boundary, to facilitate accurate registration of said first and second sub-images.

21. A method as claimed in claim 16, including the step of printing registration marks on one of said first and second sheets, at the time of printing the sub-image thereon, said registration marks being placed to facilitate alignment of said first and second sheets so that the first and second sub-images will be in register.

* * * * *